United States Patent [19]

Foster et al.

[11] 4,091,291

[45] May 23, 1978

[54] SYSTEM FOR UNDERGROUND DISTRIBUTION OF ELECTRICAL POWER AND ELECTRICAL CABLE CONSTRUCTION FOR USE THEREIN

[75] Inventors: Walter W. Foster; William H. French; Ramon I. Lindberg, all of Richmond, Va.

[73] Assignee: Reynolds Metals Company, Richmond, Va.

[21] Appl. No.: 765,122

[22] Filed: Feb. 3, 1977

Related U.S. Application Data

[63] Continuation of Ser. No. 579,895, May 22, 1975, abandoned.

[51] Int. Cl.[2] ..... H01B 7/28

[52] U.S. Cl. ..... 307/95; 204/147; 204/196

[58] Field of Search ..... 307/95; 174/115, 105 SC, 174/106 SC, 108; 204/196, 197, 147, 148

[56] References Cited

U.S. PATENT DOCUMENTS

| | | | |
|---|---|---|---|
| 2,446,387 | 8/1948 | Peterson | 174/105 |
| 2,491,225 | 12/1949 | Stearns | 204/147 |
| 3,578,982 | 4/1971 | Nelson | 307/95 |
| 3,707,595 | 12/1972 | Plate | 174/115 |
| 3,927,247 | 12/1975 | Timmons | 174/115 |

FOREIGN PATENT DOCUMENTS

| | | | |
|---|---|---|---|
| 710,100 | 6/1954 | United Kingdom | 307/95 |
| 1,379,832 | 1/1975 | United Kingdom | 307/95 |

*Primary Examiner*—David Smith, Jr.
*Attorney, Agent, or Firm*—Glenn, Lyne, Gibbs & Clark

[57] ABSTRACT

A system for the underground distribution of electrical power is provided and includes an electrical cable construction particularly adapted for use underground; and, the cable construction has a central conductor, a tubular insulator system for the conductor, a dual-purpose sacrificial anode supported by the insulator system and extending along substantially the full length of such insulator system, and a concentric neutral conductor supported by the insulator system and engaging the anode at a plurality of points therealong, with the dual-purpose sacrificial anode protecting the concentric neutral conductor against galvanic and soil corrosion as well as reducing AC corrosion of the concentric neutral conductor by providing additional surface area for the dissipation of currents leaving the neutral conductor.

21 Claims, 8 Drawing Figures

SYSTEM FOR UNDERGROUND DISTRIBUTION OF ELECTRICAL POWER AND ELECTRICAL CABLE CONSTRUCTION FOR USE THEREIN

This is a continuation of application Ser. No. 579,895, filed May 22, 1975, now abandoned.

BACKGROUND OF THE INVENTION

Numerous systems are in use for underground distribution of alternating current (AC) electrical power and these systems utilize various types of cable constructions. For example, one type of cable construction in wide use in residential areas utilizes a central conductor, comprised of one or more strands, which is insulated by a comparatively thick tubular insulator system around which is supported an exposed concentric neutral conductor which may also be comprised of one or more strands. One of the problems with such a cable construction is soil, galvanic, and AC corrosion of the neutral conductor.

Another problem with underground cable constructions of the character mentioned is that the systems used heretofore utilize tinned copper to make the neutral conductor and with the comparative short supply and high cost of copper, it has become necessary to utilize other materials, such as aluminum, for both the neutral conductor and the central conductor. However, it is important to protect cable constructions whether made totally or partially of copper or totally or partially of aluminous materials against AC corrosion as well as soil and galvanic corrosion.

Regarding cathodic protection to prevent soil and galvanic corrosion in the United States, the National Association of Corrosion Engineers has established a recommended practice through a standard referred to as RP-01-69 that there should be a minimum negative polarization voltage shift of 150 millivolts for aluminum buried underground. Accordingly, one objective in an electrical cable construction for underground use is to provide cathodic protection that will produce a minimum negative polarization voltage shift of 150 mv.

SUMMARY

This invention provides an improved system for the underground distribution of electrical power and an improved electrical cable construction for use therein. Basically the cable construction overcomes the abovementioned problems because it is comparatively inexpensive, is installed easily and economically, and resists soil, galvanic and AC corrosion over substantial time periods under normal service conditions.

The cable construction has a central conductor, a tubular insulator means or system for the conductor, a dual-purpose sacrificial anode supported by the insulator system and extending along substantially the full length of such insulator system, and a concentric neutral conductor supported by the insulator system and engaging the anode at a plurality of points therealong with the dual-purpose sacrificial anode protecting the concentric neutral conductor against soil and galvanic corrosion as well as reducing AC corrosion of the neutral conductor by providing additional surface area for the dissipation of currents leaving such neutral conductor.

Other details, uses, and advantages of this invention will be readily apparent from the exemplary embodiments thereof presented in the following specification, claims, and drawings.

BRIEF DESCRIPTION OF THE DRAWINGS

The accompanying drawings show present exemplary embodiments of this invention, in which.

DESCRIPTION OF ILLUSTRATED EMBODIMENTS

Figure 1:
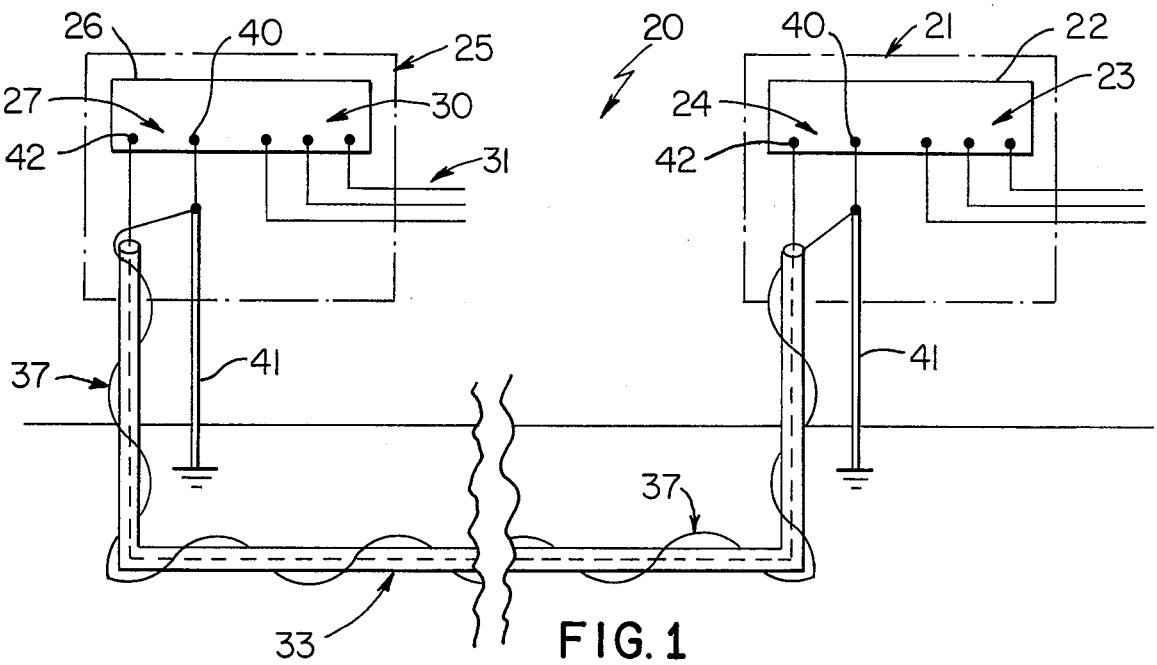
FIG. 1 is a primarily schematic view, with parts broken away, of an exemplary system for the underground distribution of alternating current (AC) electrical power with such system being made in accordance with this invention and which utilizes an exemplary electrical cable construction of this invention.

Reference is now made to FIG. 1 of the drawings which illustrates one exemplary embodiment of an improved system of this invention for the underground distribution of AC electrical power and such system is designated generally by the reference numeral 20. The system 20 comprises a power source 21 which may be any suitable source of AC power and in this example is shown as comprising a transformer 22 having secondary connections 23 and primary connections 24 and electrical power is provided to the transformer 22 from a suitable power generating station, not shown. The system 20 also comprises a consumer tie-in station indicated at 25 which for simplicity of presentation is also shown as comprising a transformer 26 having primary connections 27 and secondary connections 30 and a plurality of three lines indicated at 31 which are connected to the secondary connections 30 at one end and tie in a consumer's installation at the opposite end thereof.

Figure 2:
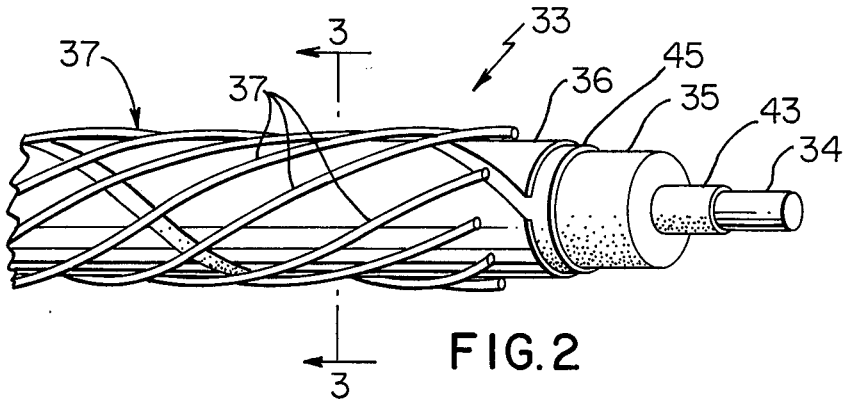
FIG. 2 is a fragmentary view of the cable construction of this invention with certain components thereof broken away at various locations to highlight the details thereof.
Figure 3:
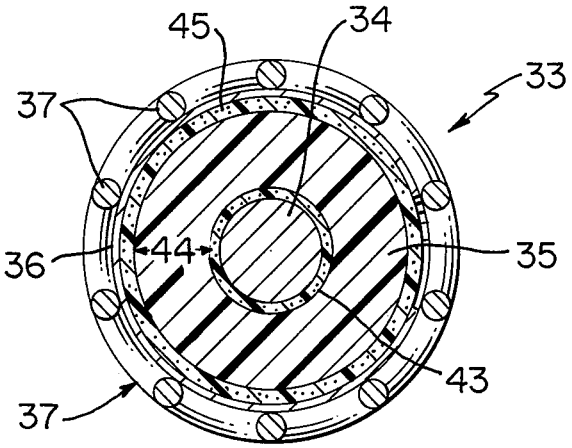
FIG. 3 is a cross-sectional view taken essentially on the line 3—3 of FIG. 2.

The system 20 of this example includes an electrical cable construction of this invention which is designated generally by the reference numeral 33; and, reference is now made to FIGS. 2 and 3 of the drawings which illustrate details of the cable construction 33. The cable construction 33 comprises a central conductor which is designated generally by the reference numeral 34, a comparatively thick tubular insulator 35 for the conductor, a sacrificial anode 36 which is supported by the insulator and extends along essentially the full length of the insulator 35, and a current-carrying neutral conductor which is designated generally by the reference numeral 37.

The neutral conductor 37 of this example is comprised of a plurality of helically wound wires each of which is also designated by the reference numeral 37, for simplicity; and, even though it may be comprised of a plurality of wires 37 the following description will often refer to the neutral conductor 37 in the singular. The neutral conductor 37 and indeed all wires thereof are supported concentrically around the insulator 35 and engage the sacrificial anode 36 at a plurality of points therealong and such plurality of points may be considered as an infinite number of points.

The sacrificial anode 36 has been referred to as a multiple-purpose or dual-purpose anode and its dual purpose can be simply stated as being the protection of the neutral conductor 37 against soil and galvanic corrosion as well as against AC corrosion. The protection against soil and galvanic corrosion is very effective because the sacrificial anode 36 is in very close proximity to, i.e., against, the concentric neutral conductor 37 which is being protected. Similarly, because the anode 36 engages the neutral conductor at a very large number of points a substantially large surface area is provided for current normally leaving the neutral conductor 37 thereby substantially reducing AC corrosion problems under normal service.

From FIG. 1 of the drawings, it will be seen that each end of the neutral conductor 37 which extends above ground level or out of the ground is connected to an associated transformer as shown at 40 in each instance while being connected to ground through the use of a grounding rod 41 and the grounding rod may be of any suitable construction or composition known in the art. It will also be appreciated that the central conductor extending from each end of the cable construction 33 is also connected to an associated transformer as illustrated by the reference numeral 42 in each instance.

The cable construction 33 may also be provided with what will be referred to as a conductor shield 43 and such shield is in the form of a comparatively thin sleeve arranged between the central conductor 34 and the thick tubular insulator 35. A typical well thickness for a sleeve 43 used in a 1/0 American Wire Gauge (AWG) electrical cable construction is generally of the order of 0.030 inch as specified by the Association of Edison Illuminating Company (AEIC) and the Insulated Power Cable Engineers Association (IPCEA) — both of these well-known organizations having well-known specifications governing power cable. The sleeve 43 is preferably made of a semi-conducting cross-linked polyethylene with the semi-conducting characteristic being provided by carbon filling the polyethylene. The shield 43 serves as a smooth electrical surface in contact with the insulation provided by insulator 35.

The insulator 35 may be any suitable elastomeric insulating material known in the art such as a cross-linked polyethylene which is preferably applied in a continuous process by extrusion over the conductor 34 and the conductor shield 43. A typical cross-linked polyethylene insulator for a 1/0 AWG cable would have a wall thickness 44 which may range between 0.175–0.345 inch, for example.

The cable construction 33 may also be provided with an outer tubular sleeve 45 which serves as a shield and outer covering for the tubular insulator 35. The sleeve 45 is also made of a semi-conducting material such as carbon filled cross-linked polyethylene and for a 1/0 AWG cable construction the shield 45 may have a thickness which may range between 0.030–0.070 inch.

The insulator means or system referred to earlier at several locations is defined by the sleeve 43, insulator 35, and the shield 45; and one or more of these components may also be referred to hereinafter as insulation means.

The sacrificial anode 36 may be made of any material which is anodic to the neutral conductor 37 and it will be appreciated that the neutral conductor may be made of copper, aluminum, or any suitable electrically conductive material. Based on cost and availability, the neutral conductor 37 is preferably made of an aluminum alloy whereby the sacrificial anode 36 is also made of an aluminum alloy anodic to the conductor 37. For example, with the usual alloys used to make a neutral conductor 37 an anode made of 7072 alloy has given satisfactory performance.

The sacrificial anode 36 may have any suitable configuration provided that initially it extends in a continuous manner along the entire length of the cable construction; and, such anode 36 may be defined of one or more strips, wires, members, etc. However, it will be appreciated that over the life of the cable, portions of such anode will be used up or "sacrificed" and the anode may not be continuous but be defined of a plurality of separated parts. Nevertheless, even though such initially continuous anode is thus defined of a plurality of spaced parts it is still very effective because it is contacted in an embracing manner at numerous points by the neutral conductor. In the cable construction 33 the anode 36 is shown as a single flat strip which is wound the entire length of the cable construction in a helical pattern.

The sacrificial anode 36 may be any suitable size or thickness; however, for a 1/0 AWG cable construction the anode 36 when in the form of a rectangular strip or ribbon of 7072 alloy may have a wall thickness ranging between 0.010 and 0.030 inch.

Having described the cable construction 33 in detail, reference is now made to FIGS. 4, 5, 6, and 7 which illustrate other exemplary embodiments of the cable construction of this invention. The cable constructions illustrated in FIGS. 4, 5, 6, and 7 are very similar to the cable construction 33; therefore, such cable constructions will be designated by the reference numerals 33A, 33B, 33C, and 33D respectively and representative parts of each cable construction which are similar to corresponding parts of cable construction 33 will be designated in the drawings by the same reference numeral as in the cable construction 33 (whether or not such components are mentioned in the specification) followed by an associated letter designation either A, B, C, or D and not described again in detail.

Figure 4:
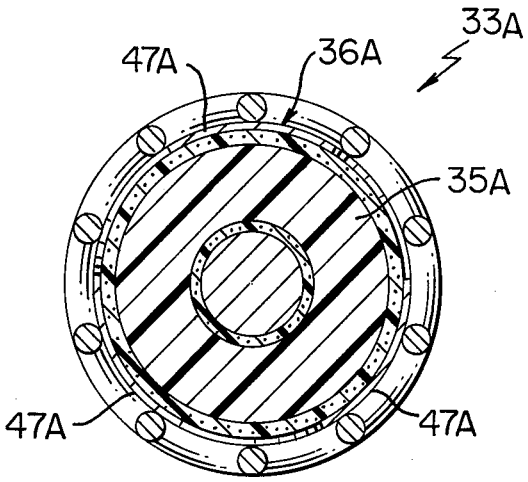
FIG. 4 is a cross-sectional view similar to FIG. 3 illustrating another exemplary embodiment of the cable construction of this invention.

The cable construction 33A of FIG. 4 instead of having a sacrificial anode defined by a single helically wound metal rectangular strip or ribbon is in the form of an anode 36A defined by a plurality of three helically wrapper ribbons each designated by the reference numeral 47A and the ribbons 47A are helically wrapped or wound in the same direction along the full length of the insulator 35A and hence along the full length of the cable construction 33A.

Figure 5:
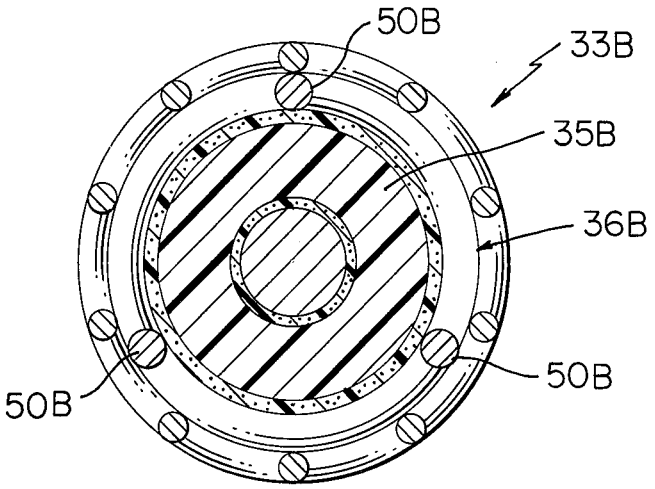
FIG. 5 is a view similar to FIG. 3 illustrating another exemplary embodiment of the cable construction of this invention.

The cable construction 33B of FIG. 5 has a sacrificial anode 36B comprised of a plurality of three cooperating metal wires 50B each of substantially circular cross-sectional configuration and each having substantially the same cross-sectional area. The wires 50B are helically wrapped along the full length of the insulator 35B and hence along the full length of the conductor 33B.

Figure 6:
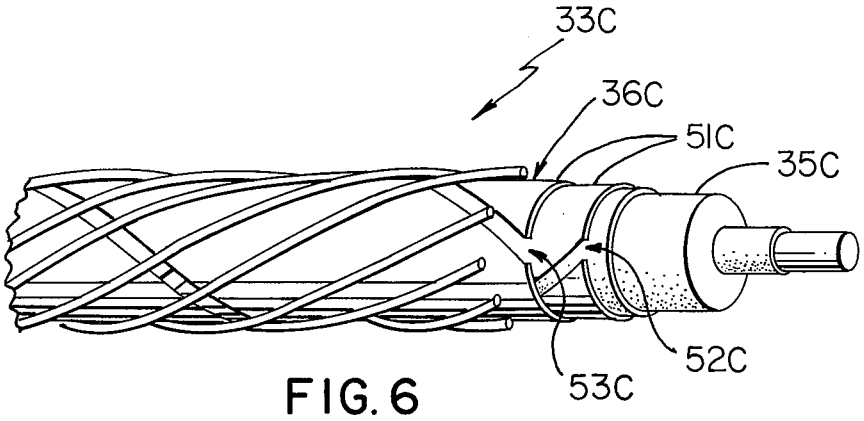
FIG. 6 is a view similar to FIG. 2 illustrating another exemplary embodiment of the cable construction of this invention.

The cable construction 33C of FIG. 6 has a sacrificial anode 36C which is comprised of two helically wrapped metal members in the form of ribbons and each of such ribbons is designated by the same reference numeral 51C. The ribbons are helically wrapped concentrically around the insulator 35C with one of the ribbons 51C being wrapped in one direction or sense along the insulator 35C and as illustrated at 52C and the other of the 51C ribbons being wrapped against the first-named ribbon 51C in an opposite direction or sense as illustrated at 53C.

Figure 7:
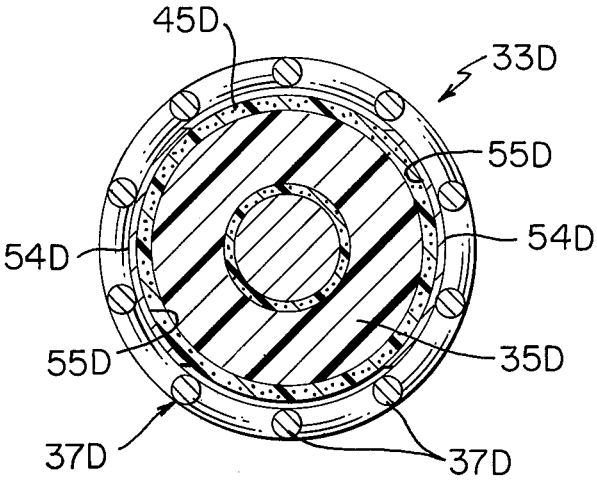
FIG. 7 is a view similar to FIG. 3 illustrating another exemplary embodiment of the cable construction of this invention.

The cable construction 33D of FIG. 7 is comprised of a pair of elongated members 54D each having an arcuate cross section including a concave surface 55D extending along the length thereof with the concave surface being particularly adapted to be cupped around the insulator 35D and in particular against the jacket 45D of such insulator 35D. The neutral conductor 37D is comprised of a plurality of wires 37D which are wrapped concentrically around and against the elongated metal members 54D.

In this disclosure of the invention, reference has been made throughout to a neutral conductor which has been designated 37 or 37A–D in the various FIGS. of the drawings. In each instance the neutral conductor is shown comprised of a plurality of components such as wires of circular cross section which are wound in a helical path around their associated insulator. However, it will be appreciated that the neutral conductor may be defined of a single component or member, if desired. Further, regardless of whether a single member or a plurality of members is involved in defining the neutral conductor in each instance each member involved may have any desired cross-sectional configuration.

Figure 8:
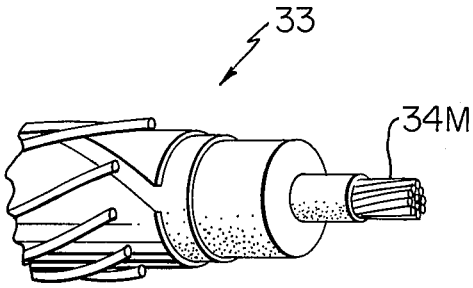
FIG. 8 is a view similar to FIG. 2 illustrating another exemplary embodiment of the cable construction of this invention which employs a standard central conductor.

In this disclosure of the invention the central conductor 34, 34A, 34B, 34C, and 34D has in each instance been shown as a conductor of solid cross section. However, it will be appreciated that each of such conductors may be a stranded conductor as illustrated in FIG. 8 of the drawings and the conductor of FIG. 8 is designated by the reference numeral 34M. The remainder of the cable construction illustrated in FIG. 8 is identical to the cable construction 33; therefore, for simplicity it will also be designated by the reference numeral 33.

It should also be emphasized that the central conductor of each cable construction may be tubular as well as solid or stranded. Further, each central conductor may be made of any suitable material such as aluminum, copper, or aluminum and copper, for example.

The cable construction of this invention may be made so that its central conductor, sacrificial anode, and neutral conductor are all made of suitable aluminous materials or these three basic components may be made of any other suitable metallic material or a plurality of suitable metallic materials capable of being used together such as steel, copper, aluminum, and alloys thereof. Further, the central conductor, sacrificial anode, and neutral conductor may each be made of one member or of a plurality of members, as desired.

In this disclosure, the neutral conductor has in each instance been shown defined by a plurality of wires of solid cross section. However, it will also be appreciated that the neutral conductor, whether comprised of one or more members, may also be made of stranded members or tubular members and such members may have any desired cross-sectional configuration.

The concentric neutral conductor whether made of one or more members may serve as a binding or fastening means or tape for embracing and holding the sacrificial anode (whether of one or more components) tightly against the sleeve 45 or tightly against the insulator 35 if no sleeve is used. This construction allows the cable construction 33, as well as constructions 33A–33D, to be easily installed without the need for special connections and procedures of the type required in prior art systems where separate discrete sacrificial anodes are employed.

While present exemplary embodiments of this invention, and methods of practicing the same have been illustrated and described, it will be recognized that this invention may be otherwise variously embodied and practiced within the scope of the following claims.

What is claimed is:

1. An underground AC electrical power cable construction having an uncovered neutral conductor and an integral sacrificial anode protecting the neutral conductor, said cable construction also comprising a central conductor and tubular insulator means for said central conductor, said sacrificial anode being supported by said insulator means and extending along substantially the full length thereof, said neutral conductor being supported by said insulator means concentrically therearound and engaging said sacrificial anode at a plurality of points therealong, said sacrificial anode protecting said neutral conductor underground against soil and galvanic corrosion as well as reducing AC corrosion of said neutral conductor by providing additional surface area for the dissipation of currents leaving the neutral conductor.

2. A cable construction as set forth in claim 1 in which said sacrificial anode is made of an aluminous material.

3. A cable construction as set forth in claim 1 in which said conductors and said sacrificial anode are each made of an aluminous material, said sacrificial anode being of an aluminous material which is anodic to said neutral conductor.

4. A cable construction as set forth in claim 1 in which said sacrificial anode is a single helically wrapped ribbon.

5. A cable construction as set forth in claim 1 in which said sacrificial anode comprises a plurality of helically wrapped ribbons.

6. A cable construction as set forth in claim 1 in which said sacrificial anode comprises two ribbons helically wrapped around said tubular insulator means, one of said ribbons being wrapped in one direction along said insulator means and the other of said ribbons being wrapped concentrically around the first-named ribbon in an opposite direction.

7. A cable construction as set forth in claim 1 in which said sacrificial anode comprises at least one helically wrapped wire which is wrapped around said tubular insulator means.

8. A cable construction as set forth in claim 1 in which said sacrificial anode is comprised of a plurality of wires which are helically wrapped around said tubular insulator means, each of said wires having a circular cross section.

9. A cable construction as set forth in claim 1 in which said sacrificial anode comprises at least one substantially rectilinear member which is supported along said tubular insulator means.

10. A cable construction as set forth in claim 1 in which said sacrificial anode comprises a pair of elongated members each having an arcuate cross section and a concave surface extending the length thereof, said concave surface being particularly adapted to be cupped around said insulator means.

11. A cable construction as set forth in claim 1 in which said tubular insulator means comprises a main tubular insulator and a conductor shield in the form of a sleeve sandwiched between said central conductor and said main insulator, said shield being in the form of a cross-linked polyethylene having a smooth electrical surface in contact with said main insulator.

12. A cable construction as set forth in claim 1 in which said tubular insulator means further comprises a jacket of polyethylene extruded concentrically around said main insulator.

13. A system for the underground distribution of AC electrical power comprising, a power source, a consumer tie-in station, and an underground AC power cable construction having one end portion operatively connected to said power source and having on an opposite end portion operatively connected to said tie-in station, said cable construction having an uncovered neutral conductor and an integral sacrificial anode protecting the neutral conductor, said cable construction also comprising a central conductor and tubular insulator means for said central conductor, said sacrificial anode being supported by said insulator means and extending along substantially the full length thereof, said neutral conductor being supported by said insulator means concentrically therearound and engaging said sacrificial anode at a plurality of points therealong, said sacrificial anode protecting said neutral conductor underground against soil and galvanic corrosion as well as reducing AC corrosion of said neutral conductor by providing additional surface area for the dissipation of currents leaving the neutral conductor.

14. A system as set forth in claim 13 in which said tubular insulator means comprises a main tubular insulator and a tubular sleeve for said central conductor made of a semi-conducting elastomeric material, said tubular sleeve providing a smooth electrical surface in contact with said main tubular insulator.

15. A system as set forth in claim 13 in which said sacrificial anode of said cable construction is a single helically wrapped ribbon.

16. A system as set forth in claim 13 in which said sacrificial anode comprises a plurality of members.

17. A system as set forth in claim 16 in which said plurality of members comprises a plurality of helically wrapped ribbon-like members.

18. A system as set forth in claim 16 in which said plurality of members comprises two ribbons helically wrapped around said tubular insulator means, one of said ribbons being wrapped in one direction along said insulator means and the other of said ribbons being wrapped concentrically around the first-named ribbon in an opposite direction.

19. A system as set forth in claim 16 in which said plurality of members comprises a plurality of rectilinear members supported along said tubular insulator means by said neutral conductor and said neutral conductor is defined by a plurality of helically wound strands.

20. A system as set forth in claim 16 in which said tubular insulator means comprises, a main tubular insulator, a conductor shield in the form of a sleeve sandwiched between said central conductor and said main insulator, said shield being in the form of a cross-linked polyethylene having a smooth electrical surface in contact with said main insulator, and a jacket of polyethylene extruded concentrically around said main insulator.

21. An underground AC electrical power cable construction having an uncovered neutral conductor and an integral sacrificial anode protecting the neutral conductor, said cable construction also comprising, a central conductor and tubular insulator means for said central conductor, said sacrificial anode being supported by said insulator means and extending along substantially the full length thereof, said neutral conductor being supported by said insulator means concentrically therearound and engaging said sacrificial anode at a plurality of points therealong, said neutral conductor embracing and holding said sacrificial anode tightly against said insulator means, said sacrificial anode protecting said neutral conductor underground against soil and galvanic corrosion as well as reducing AC corrosion of said neutral conductor by providing additional surface area for the dissipation of currents leaving the neutral conductor.

* * * * *